US008720158B2

(12) United States Patent
Young

(10) Patent No.: US 8,720,158 B2
(45) **Date of Patent: *May 13, 2014**

(54) STAIR TREAD OVERLAY AND METHOD

(71) Applicant: Robert H. Young, Beaver Dam, KY (US)

(72) Inventor: Robert H. Young, Beaver Dam, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/764,256

(22) Filed: Feb. 11, 2013

(65) Prior Publication Data

US 2013/0152494 A1 Jun. 20, 2013

Related U.S. Application Data

(63) Continuation of application No. 13/431,349, filed on Mar. 27, 2012, now Pat. No. 8,371,090, which is a continuation of application No. 12/760,114, filed on Apr. 14, 2010, now Pat. No. 8,141,321.

(60) Provisional application No. 61/266,598, filed on Dec. 4, 2009.

(51) Int. Cl.
*E04B 1/00* (2006.01)
*E04F 11/104* (2006.01)

(52) U.S. Cl.
CPC ..... *E04F 11/104* (2013.01)
USPC ..... 52/741.2; 52/188; 52/191

(58) Field of Classification Search
USPC ..... 52/182, 183, 184, 188, 191, 222, 223, 52/287.1, 741.1, 741.2
See application file for complete search history.

(56) References Cited

U.S. PATENT DOCUMENTS

| | | | | | |
|---|---|---|---|---|---|
| 718,821 | A | * | 1/1903 | Cooper | 52/179 |
| D167,994 | S | | 10/1952 | McKay | |
| D222,894 | S | | 1/1972 | Taylor | |
| 5,357,724 | A | | 10/1994 | Sonoda | |
| 5,475,951 | A | | 12/1995 | Litzow | |
| D389,588 | S | | 1/1998 | Dunk | |
| 5,787,674 | A | * | 8/1998 | Nelson | 52/741.2 |
| 5,806,253 | A | * | 9/1998 | Nelson | 52/179 |
| 6,073,408 | A | * | 6/2000 | Winer et al. | 52/385 |
| 6,115,975 | A | * | 9/2000 | Abdollahi | 52/179 |
| 6,156,402 | A | * | 12/2000 | Smith | 428/40.1 |
| 6,230,454 | B1 | | 5/2001 | Meagher | |
| 6,920,725 | B2 | * | 7/2005 | Lanphier | 52/182 |
| 6,960,273 | B2 | * | 11/2005 | Jung | 156/98 |

(Continued)

OTHER PUBLICATIONS

"Nustair Stair Refacing System", Ideal Stair Parts, Little Falls, NY, Apr. 7, 2010, 4pages.

(Continued)

*Primary Examiner* — William Gilbert
*Assistant Examiner* — Gisele Ford
(74) *Attorney, Agent, or Firm* — Berenato & White, LLC

(57) ABSTRACT

A stair tread overlay includes a tread and a front nosing attached to a front edge of the tread by a tongue and groove joint to provide a strong mechanical joint between the nosing and tread. Adhesive may be applied at the tongue and groove joint to enhance the strength of the joint. A horizontally symmetrical side nosing having a profile matching the profile of the front nosing may be attached an edge of the tread adjacent to the front nosing. The stair tread and nosings may be in the form of a kit used to cover an existing staircase to enhance the appearance of the staircase. The method of making the overlay is also disclosed.

13 Claims, 9 Drawing Sheets

(56) References Cited

U.S. PATENT DOCUMENTS

| | | | | |
|---|---|---|---|---|
| 7,861,477 | B2 * | 1/2011 | Donetti et al. | 52/403.1 |
| D644,743 | S | 9/2011 | Lopez | |
| 2003/0182880 | A1 | 10/2003 | Weaber et al. | |
| 2011/0179729 | A1 * | 7/2011 | Thompson | 52/179 |

OTHER PUBLICATIONS

United States District Court District of New Jersey, "Complaint and Demand for Jury Trial", Case 3:12-cv-05883-MAS-TJB, Document 1, Filed Sep. 19, 2012, *ML Design Group, LLC* v. *Young Manufacturing Company, Inc.*; Robert Young, an individual; John Smith, an individual; and ABC Companies.

* cited by examiner

STAIR TREAD OVERLAY AND METHOD

CROSS-REFERENCE TO RELATED APPLICATIONS AND CLAIM TO PRIORITY

This application is a continuation of U.S. application Ser. No. 13/431,349, filed Mar. 27, 2012, now U.S. Pat. No. 8,371,090, which is a continuation of U.S. application Ser. No. 12/760,114, filed Apr. 14, 2010, now U.S. Pat. No. 8,141,321, which is related to U.S. Provisional Application No. 61/266,598, filed Dec. 4, 2009, the disclosure of which is incorporated herein by reference and to which priority is claimed.

FIELD OF THE INVENTION

Homes typically have a variety of floor coverings, such as carpet, hardwood, marble, linoleum and tile. The decision as to which type of flooring to use in each room may be based on aesthetics, comfort, durability, functional and financial reasons. For instance, many people find hardwood flooring aesthetically appealing and therefore will place hardwood in hallways and dining rooms. Likewise, other hard floorings, such as tile, marble, or linoleum are typically used in bathrooms and kitchens, because carpet in such environments would stain or become mildewed when wet. Carpets are often preferred in living rooms and bedrooms because it is softer, cheaper, reduces noise, and retains warmth better than wood flooring. In some cases, a multi-story home will have hard flooring on the first level, which typically contains a kitchen, living room, and dining room, while the other levels, which typically contain the bedrooms, will be carpeted.

In order to save money on construction, carpeted floors are usually provided with a simple plywood subfloor underneath. In certain instances this may extend to staircases which are intended to be carpeted. Unfinished wood, such as plywood, is used to construct the treads and the risers of the staircase which is then completely covered by carpet after installation in the home, and thus the plywood cannot be seen.

There may come a time when a homeowner chooses to redecorate by replacing carpeted floors with hard flooring. In the rooms and halls carpet may be removed and hardwood flooring may be easily placed over the plywood subfloor. Replacing stairs, however, is more expensive and requires more labor because the existing stairs must be removed and a new set of finished stairs put in their place. Removal of the existing staircase is not only expensive, but may also limit access to other floors in the home during construction.

BACKGROUND OF THE INVENTION

When forming an overlay for stairs, the prior art typically employs a two-piece structure comprising a tread and a front nosing adhesively secured together along flat abutting surfaces. However, because the front nosing is subjected to considerable stress during the use of the stairs, this construction is prone to failure.

SUMMARY

An exemplary embodiment of a stair tread overlay comprises a wooden finished stair tread having an outer surface, an inner surface and an attached projecting tongue. The overlay also has a front nosing with a groove formed into its inner surface. The tongue of the stair tread mates with the groove of the front nosing to connect the two, which are preferably adhesively attached. The overlay may also comprise a side nosing which is secured to the stair tread. Alternatively, the tongue may extend from the nosing and the groove be formed in the stair tread.

An exemplary method of making a stair tread overlay comprises forming a wooden stair tread having an outer surface, an inner surface, and a pair of end surfaces. A tongue is formed into one of the end surfaces. A front nosing is provided having an outer surface, an inner surface, and a groove formed into the inner surface. A horizontally symmetrical side nosing may also be provided. The tongue of the stair tread and the groove of the front nosing are mated and an adhesive secures the joint. The thickness of the stair tread may then be reduced. Optionally, at least one end of the side nosing is trimmed and attached to the stair tread to form the overlay.

An exemplary embodiment for a method of creating a finished appearance to a set of stairs comprises providing a wooden finished stair tread having an outer surface, an inner surface, a pair of end surfaces, and a tongue projecting from one of the end surfaces. A front nosing is provided having an outer surface, an inner surface, and a groove formed in the inner surface. A horizontally symmetrical side nosing having a first end and a second end may also be provided. The tongue of the finished stair tread is mated with the groove of the front nosing to connect the two, and the tread and the tongue and groove are adhesively secured. Optionally when the staircase has an open side extending all or a portion of its length, one of the ends of the side nosing is trimmed and the side nosing is attached to the finished stair tread. The finished stair tread is then attached to a previously constructed stair tread.

The tongue and groove construction avoids the failure problems of the prior art due to the extremely large surface area of the joint formed by the tongue and groove, especially when enhanced by an appropriate adhesive. The tongue and groove construction provides an increased surface area over which the adhesive may be applied, to thereby create a joint stronger than a joint between flat abutting surfaces. Also, the mechanical interlock of the tongue and groove joint provides a much stronger joint over flat abutting surfaces, because the force applied to the nosing can cause a flat joint to separate. The strength of the joint between the front nosing and the tread is especially important because of the forces imposed on the front nosing during use of the steps. The tongue and groove connection provides a mechanical support, that resists breaking when the steps are used and minimizes the shear force applied to the adhesive connection.

DETAILED DESCRIPTION OF THE PREFERRED EMBODIMENT(S)

Figure 1:
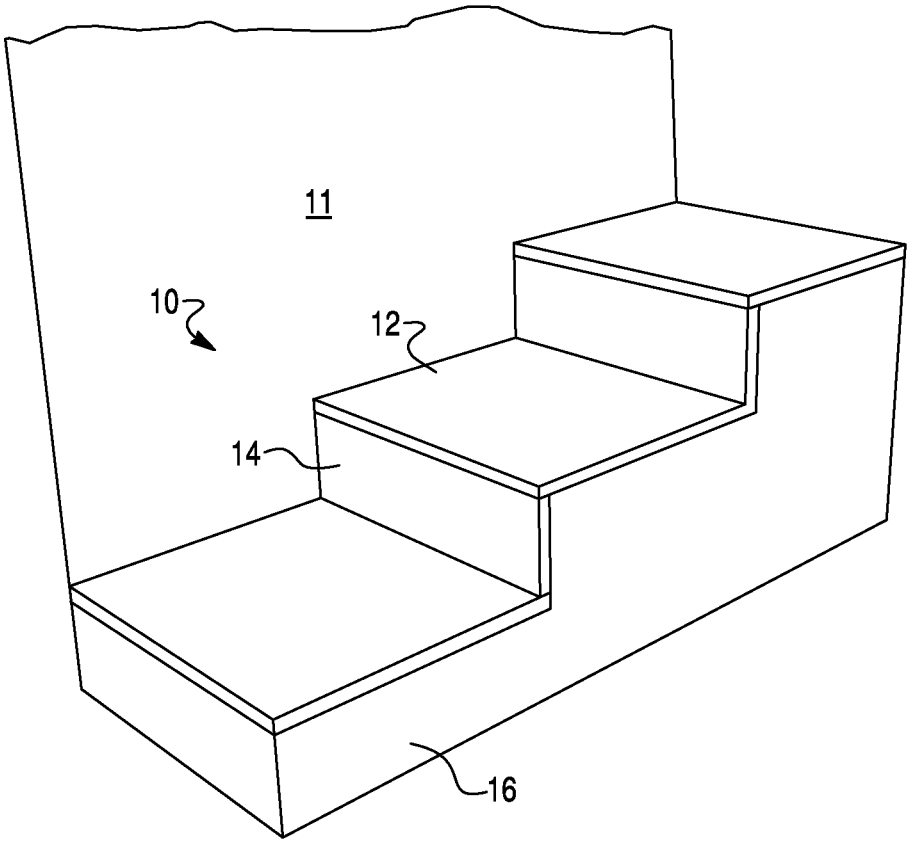
FIG. 1 is a perspective view of an unfinished physical stair case.
Figure 2:
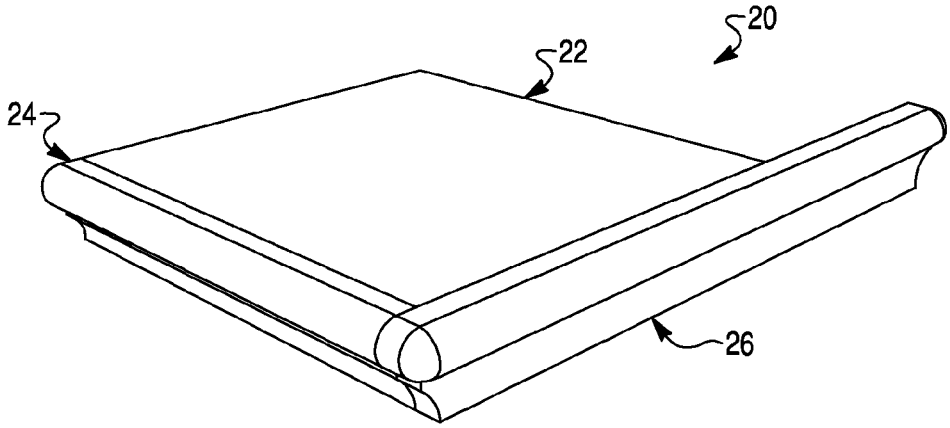
FIG. 2 is a perspective view of a stair tread overlay.
Figure 3:
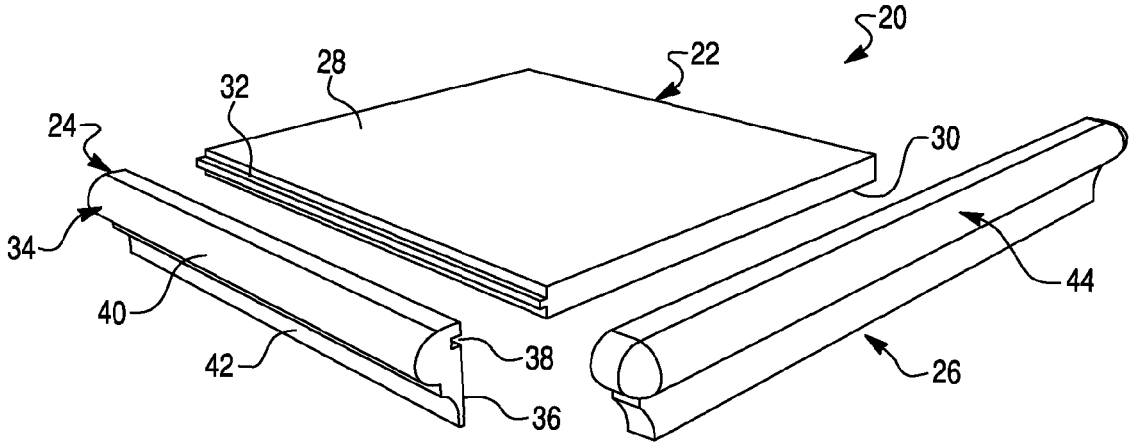
FIG. 3 is an exploded assembly view of the stair tread overlay of FIG. 2.
Figure 4:
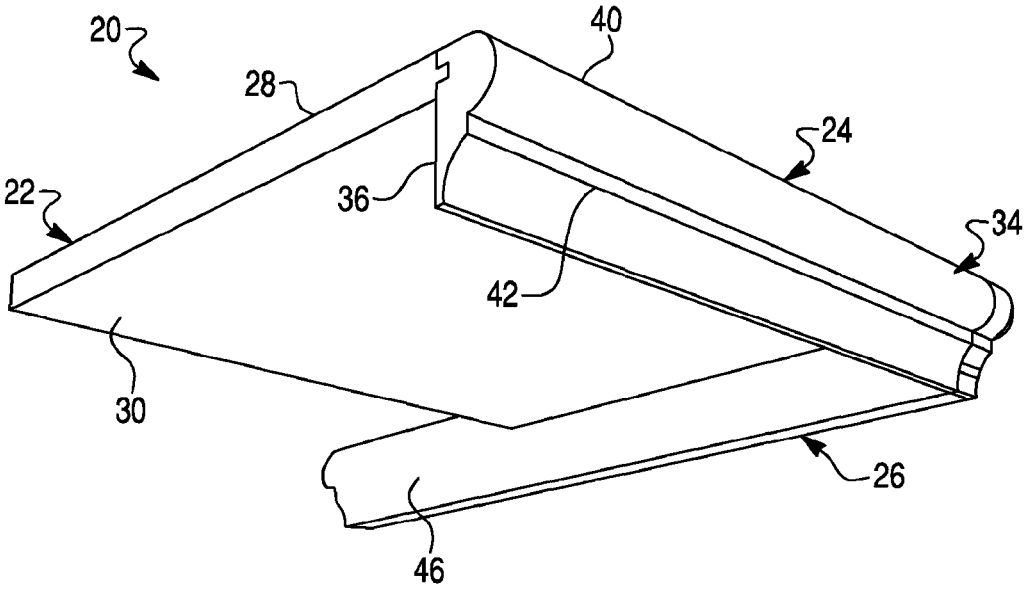
FIG. 4 is a bottom perspective view of a stair tread overlay.
Figure 5:
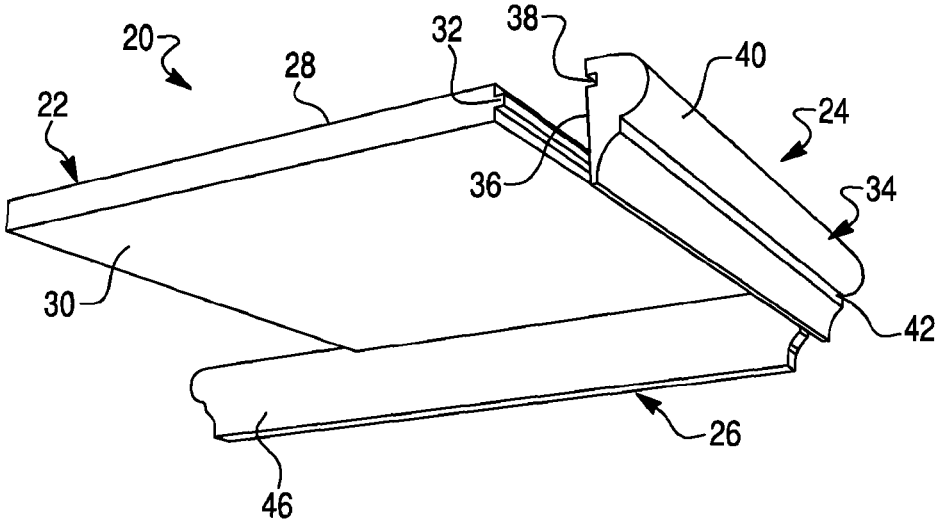
FIG. 5 is an exploded assembly view of the stair tread overlay of FIG. 4.

The present invention is directed to an overlay for giving a finished or decorative appearance to a set of stairs, eliminating the need to tear out and replace existing unfinished stairs. FIG. 1 shows an unfinished set of stairs 10. The stairs 10 may be open along one end/side opposite wall 11 or the stairs 10 may be closed along both sides. The stairs have a series of treads 12 and risers 14, which are framed by a stringer 16. Unfinished stairs 10 are typically constructed out of a wood composite material such as plywood, fiber board, oriented strand board or the like. The stairs 10 typically are covered by carpet, although in certain cases, such as stairs to an unfinished basement, they may be left exposed.

An exemplary embodiment of a finished stair overlay 20 is shown in FIGS. 2-16. The overlay 20 comprises a stair tread 22, a front nosing 24, and a side nosing 26. The stair tread 22, front nosing 24 and side nosing 26 are all preferably made of solid wood and a preferably all of the same species in order to enhance the aesthetic appeal of the resulting resurfaced staircase. Tread 22 and nosings 24, 26 are preferably all made out of the same type of wood, which may be oak. The tread and front nosing are solid wood, not a wood composite or layered wood product like plywood, in order to provide maximum strength. The type of wood used may vary depending upon the application and the surrounding flooring and may be coated with different types and colors of stain or paint. As best shown in FIGS. 2-5, which illustrate a staircase open along one side, the front nosing 24 and the side nosing 26 extend around the tread 22, forming an open space. This open space fits around an existing stair tread, while the nosings 24, 26 will cover any exposed joints as described in further detail below.

Figure 6:
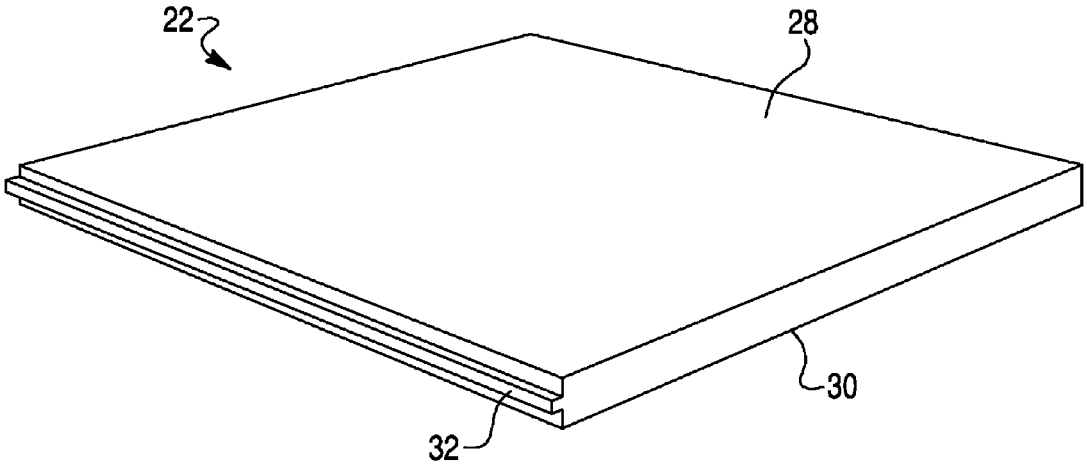
FIG. 6 is a perspective view of a finished stair tread.
Figure 7:
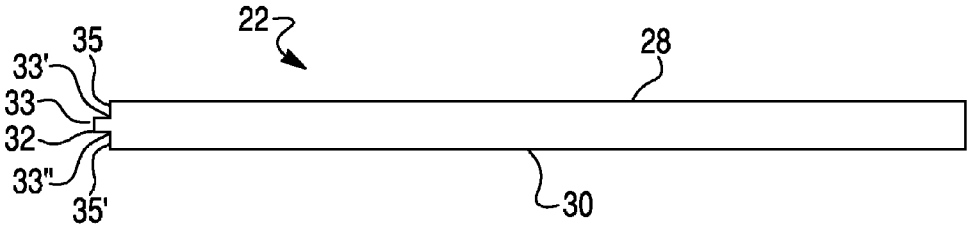
FIG. 7 is a side elevational view of the finished stair tread of FIG. 6.

As best shown in FIGS. 6-7, the stair tread 22 has an outer surface 28, and an inner surface 30. The stair tread 22 may be made out of a single piece of wood or a number of smaller pieces of wood adhesively bound together such as by lamination. When multiple pieces of wood are used to form the stair tread 22 they may be attached together by an adhesive, mechanical fasteners, or through a variety of wood joints. Additionally, a tongue 32, projecting from tread 22, may be formed into a side edge of the stair tread 22, such as through use of a milling machine. This tongue 32 forms part of a joint used to connect the stair tread 22 with the front nosing 24. As best shown in FIG. 7, the tongue 32 has a front surface 33 and side surfaces 33' and 33". The tread 22 has front surfaces 35 and 35'. Surfaces 33' and 33" extend in parallel perpendicular to surfaces 35 and 35', which are parallel as well.

Figure 8:
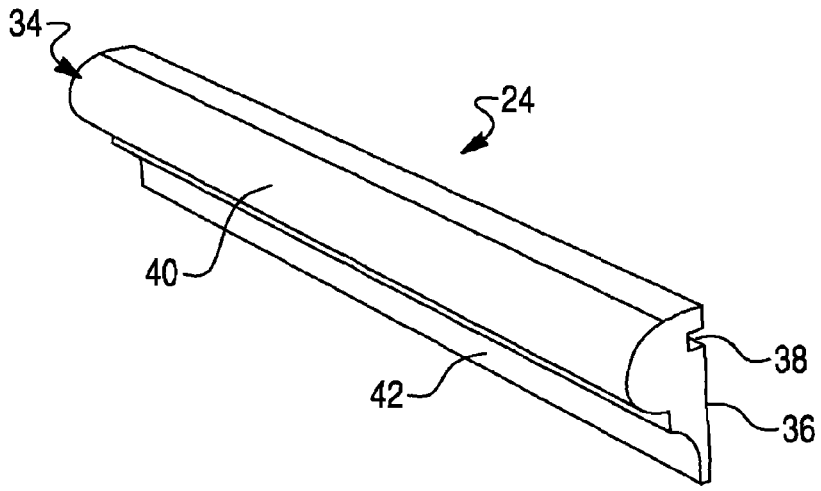
FIG. 8 is a perspective view of a front nosing.
Figure 9:
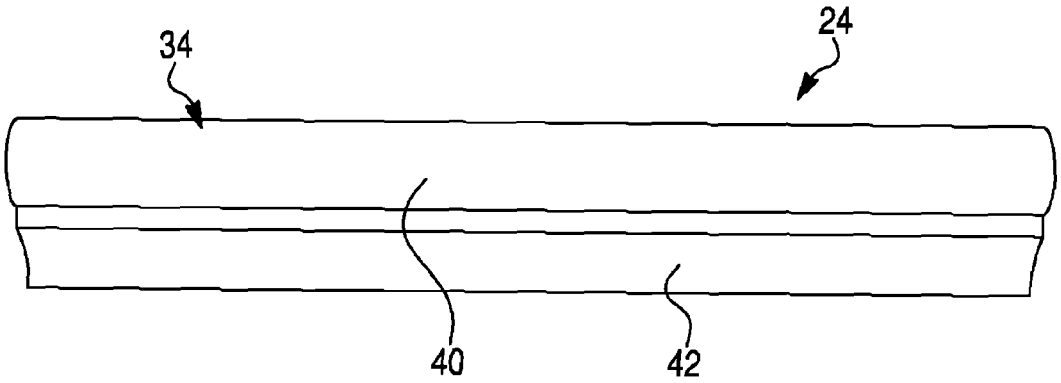
FIG. 9 is a front elevational view of the front nosing of FIG. 8.
Figure 10:
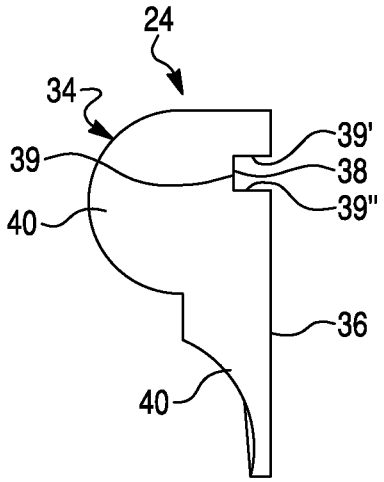
FIG. 10 is a side elevational view of the front nosing of FIG. 8.
Figure 11:
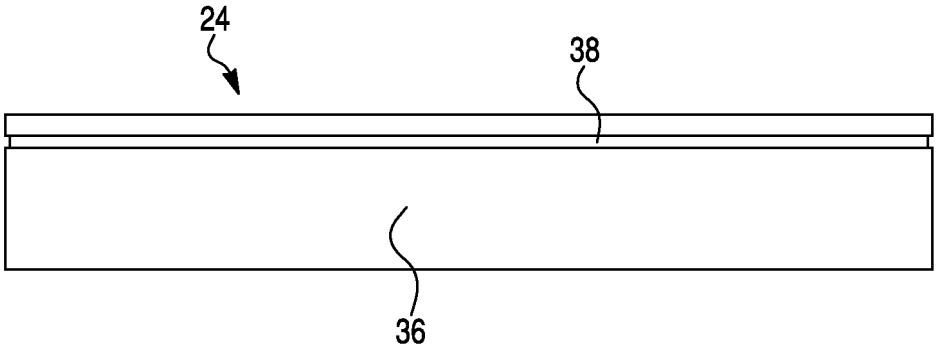
FIG. 11 is a rear elevational view of a front nosing of FIG. 8.

As best shown in FIGS. 8-11, the front nosing 24 has an outer surface 34 and an inner surface 36. A groove 38 is located along the inner surface 36 of the front nosing 24. The groove 38 mates with the tongue 32 of the tread 22 to form a joint. The tongue 32 and groove 38 extend the length of their respective components in order to create the maximum size joint. Although this configuration is illustrated in the Figures, the groove 38 may be located in the tread 22 and the tongue 32 located along the front nosing 24. Other types of wood joints may also be used, such as a dowel joint, a mortise joint, or a dovetail joint. Additionally, mechanical fasteners such as nails, tacks, screws, or staples may be used to connect the tread 22 to the front nosing 24. Groove 38 has inner surface 39 and parallel surfaces 39' and 39", as best shown in FIG. 10. Surfaces 39' and 39" extend perpendicular to surface 36. Preferably the tongue 32 and groove 38 extend about 0.13 inches and the distance between surfaces 39' and 39" and 33' and 33" is about 0.20 inches.

An adhesive is utilized with the wood joint joining tread 22 to side nosing 24 to further secure the connection. The adhesive may be applied to either the tongue 32, the groove 38, or to both. The tread 22 and the front nosing 24 are then mated together and the adhesive is allowed to cure. While any suitable adhesive may be used, it should preferably have a fifty percent cure time of approximately thirty minutes and a strength of at least 2,500 psi. An example of such an adhesive is copolymer polyvinyl acetate adhesive. Other adhesives include urea formaldehyde adhesive, animal glue, urethane adhesive, polyurethane (PUR) adhesive and cross-linked polyvinyl acetate adhesive. Because of the tongue 32 and the groove 38, the surface area available for adhesive connection is more than forty percent (40%) greater than available with a flush joint. Thus the tongue and groove joint not only provides enhanced safety because of the mechanical stop, but also provides increased adhesive connection. Due to the length of the surfaces 33' and 33" and 39' and 39" and the distance between those surfaces, should a user apply force, such as while climbing the stairs, on nosing 24, then the surface 39' is prevented from moving downwardly by surface 33'. Further, surface 36 of nosing 24 rests against surface 35', and thus is prevented from cantilevering. The surfaces 35 and 35' are also approximately 0.21 inches in length, thus providing substantial length to prevent cantilevering. As best shown in FIG. 10, the groove 38 is located toward to top of nosing 24, whereas the tongue 32 is in the middle of the tread 22. This mechanical arrangement maximizes the ability of the nosing 24 to resist being separated from tread 22 when a user walks on nosing 24, because the long length of surface 36 assists in resisting twisting of the nosing 24 about tongue 32.

After the tread 22 and the front nosing 24 are connected, the two may be machined to remove material from their inner surfaces 30, 36 in order to reduce the thickness of the tread. For example the tread 22 may be machined from an initial ¾" thickness to a final ⅝" thickness. Additionally the thickness of the front nosing 24 may be reduced so that it is in alignment with the front surface of tread 22. This operation provides a number of benefits to the overlay. Removing material allows the overlay 20 to be formed to a desired size. Machining the two pieces blends the joint between the edge of the tread 22 and the inner surface 36 of the front nosing 24. Machining also ensures a ninety-degree interface between the tread 22 and the front nosing 24 and provides a smooth and level interior surface that may be easily attached to an existing stair tread. Furthermore, the overlay should be relatively thin so that the rise of the stairs remains essentially the same The front nosing 24 may contain a design or contour as best shown in FIGS. 8-10. This design may be formed either before or after the front nosing 24 has been attached to the tread 22. The top portion 40 of the front nosing 24 may be rounded, while the bottom portion contains a downwardly extending trim 42. The trim 42 may have a design such as an edge and a concave groove. This trim 42 will cover the joint between the riser and the tread of the existing set of stairs, while providing a decorative appearance to the overlay 20.

Figure 12:
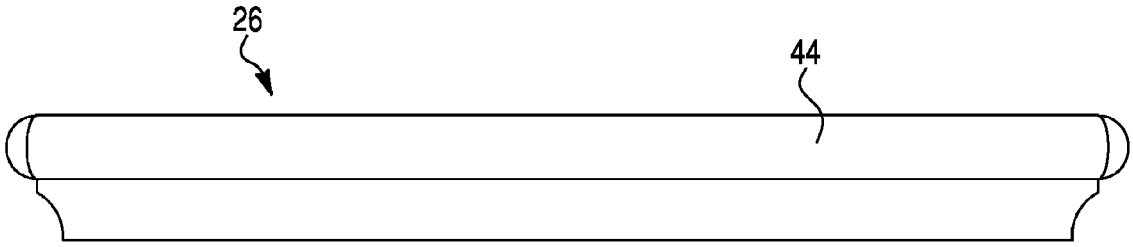
FIG. 12 is a front elevational view of a side nosing.
Figure 13:
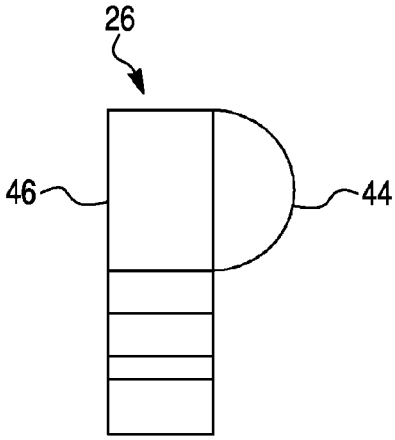
FIG. 13 is a side elevational view of the side nosing of FIG. 12.

Should the existing stairs have an exposed side edge, the overlay 20 may further comprise a side nosing 26. As best shown in FIGS. 12-13, the side nosing 26 has an outer surface 44 and an inner surface 46. The outer surface 44 may contain a design element or contour similar to or matching the contour of front nosing 24. Preferably, the design element on the side nosing 26 will correspond to the design element on the front nosing 24, giving the appearance that the completed overlay 20 is made out of a single piece of wood.

As best shown in FIG. 12, the side nosing 26 is formed so that it is symmetric about its length. By making the side nosing 26 symmetric, a single side nosing 26 may be used to finish stair cases having either an exposed right-hand side edge or an exposed left-hand side edge. On the job site, the side nosing 26 may be trimmed at either end depending on which direction the exposed edge faces. The length of the side nosing 26 may also be shortened to correspond with the length of the exposed side edge of the existing stairs. The side nosing 26 may then be attached to the overlay 20, covering any exposed joints on the side of the existing stairs. Unlike the front nosing 24, the side nosing 26 has no tongue or groove and instead surface 46 is flat to mate with the flat side surface of tread 22. The added expense of the tongue and groove is avoided because the side nosing is normally not subjected to the large forces the front nosing is subjected to.

The side nosing 26 may be attached to the overlay 20 by an adhesive, by a wood joint, by mechanical fasteners such as nails, staples, tacks or screws, or by any other suitable means. If the overlay 20 is being used in a location where the tread 22 may expand due to moisture, the side nosing 26 may be attached via a moisture compensated joint as described in commonly owned U.S. Pat. No. 5,088,247, incorporated herein by reference, which joint may be a mitered joint or other shaped joint. The side nosing 26 may be attached to the overlay 20 either before or after the overlay 20 is secured to an existing stair tread.

The components of overlay 20 may be manufactured so that their initial size is greater than most existing stairs, allowing them to be used to finish a variety of stair cases. Therefore, any of the components of the overlay 20 may be trimmed so that the size of the overlay 20 matches the existing stairs.

Figure 14:
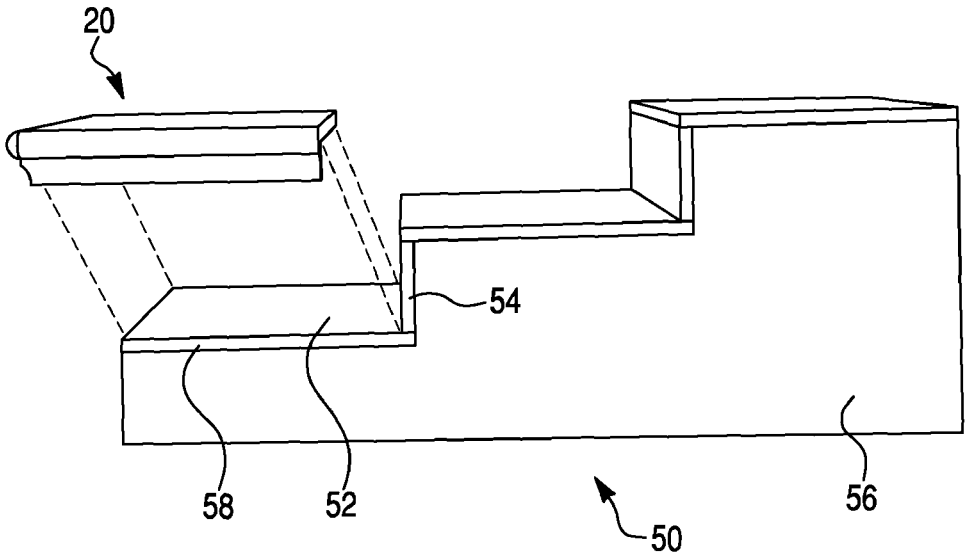
FIG. 14 is a left side schematic view of a stair tread overlay with a set of unfinished stairs.
Figure 15:
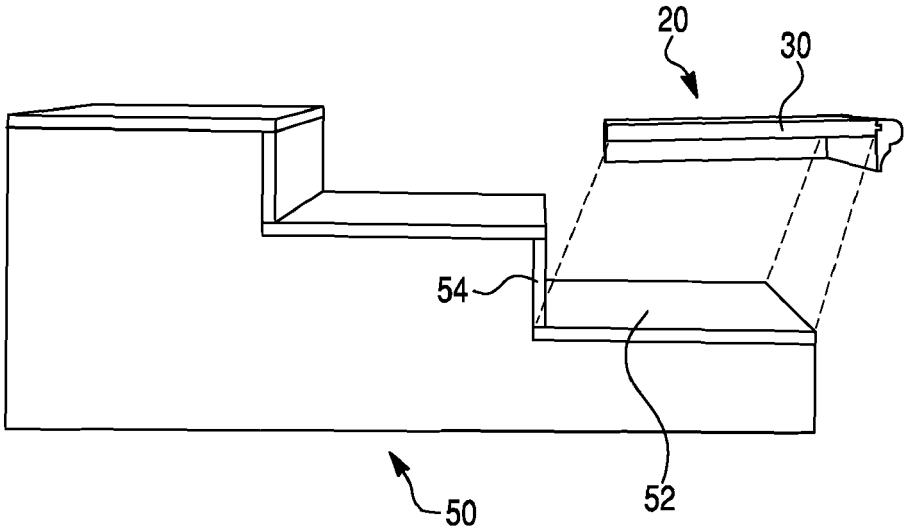
FIG. 15 is a right side schematic view of a stair tread overlay with a set of unfinished stairs.
Figure 16:
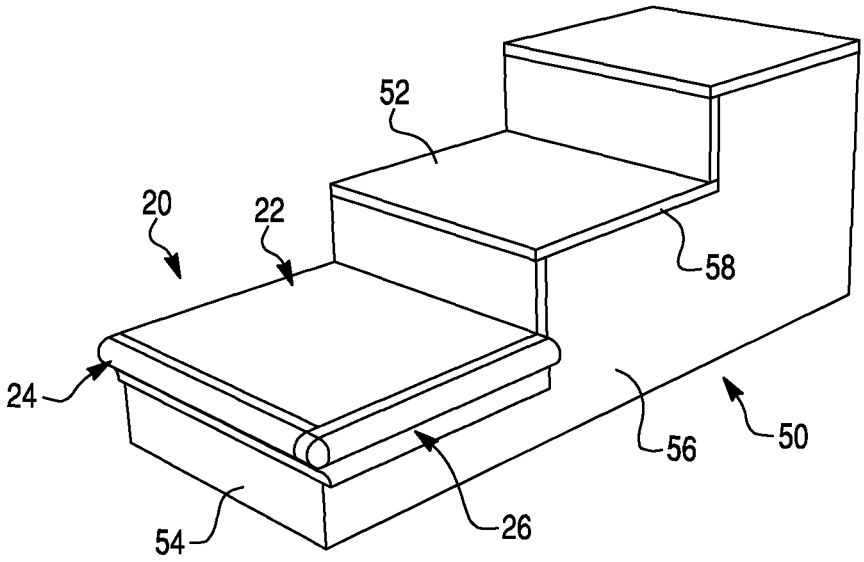
FIG. 16 is a perspective view of a stair tread overlay with a set of unfinished stairs.

After being trimmed to the appropriate size, the overlay 20 is attached to an existing set of stairs 50 as best shown in FIGS. 14-16. The stairs 50 contain treads 52, risers 54, a stringer 56, and exposed side edges 58. The tread 52 may have an edge that projects beyond riser 54. In that event, the projecting portion of tread 52 needs to be removed so that the edge of the tread 52 is in planar alignment with the riser 54. To attach the overlay 20 to the stairs 50, the inner surface 30 of the tread 22 is affixed to a tread 52. The overlay 20 is preferably attached to the existing stair tread 52 via an adhesive such as polyurethane glue, though mechanical fasteners such as nails, staples, screws, or tacks, or any suitable means may be used. As discussed above, the side nosing 26 is trimmed and may be attached to the overlay 20 either before or after it is attached to the existing stair tread 52. As best shown in FIGS. 14-16, the right end of the side nosing 26 has been removed to conform to the edges 58 of this particular set of stairs 50. When the overlay 20 is placed over the existing stairs 50, the finished tread 22 will lay flush over the existing tread 52. As best shown in FIG. 16, the front nosing 24 covers at least part of the riser 54, hiding the joint between the existing tread 52 and riser 54. Similarly, the side nosing 26 will hide the joint between the side edges 58 and the riser 54.

If the existing treads 52 extend beyond the riser 54, the overhanging portion may be removed so that the attached overlay 20 will fit flush against the stairs 50. In order to provide a completely finished look to the stairs 50, any remaining exposed portion of the riser 54 may be covered with a facing such as a veneer. Preferably the veneer will match or be similar to the color and grain of the overlay 20. If necessary, veneer may also be applied to any other unfinished visible elements such as the exposed stringer 56.

Though the present invention may be best utilized in providing a finished appearance to an unfinished set of stairs, it may also be used to give a set of stairs a decorative or new appearance. A worn set of finished stairs may be trimmed or sanded as necessary and the overlay attached thereto to provide a new finished appearance. The overlay may also be used in new construction. A simple unfinished staircase may be constructed and the overlay placed over top of it as described above. This will provide a cheaper alternative stair case which could be easily changed or replaced in the future as needed.

The foregoing description of the exemplary embodiments of the present invention has been presented for the purpose of illustration. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. Moreover, features or components of one embodiment may be provided in another embodiment. Thus, the present invention is intended to cover all such modification and variations.

What I claim is:

1. A method of making a stair tread overlay, comprising the steps of:

providing a generally planar stair tread having an outer surface, an inner surface and end surfaces between the outer and inner surfaces;

forming one of a tongue or groove in one of the end surfaces of the stair tread, said one of the end surfaces defining a vertical plane;

providing a nosing having a top planar surface, a bottom terminal surface, a front contoured nose surface and a planar back side surface, the other of a tongue or groove disposed on said back side surface thereof, a portion of said back side surface abutting said edge of said stair tread along said vertical plane;

forming the other of a tongue or groove along the planar back side surface of the front nosing;

mating the tongue and the groove and thereby securing the front nosing to the stair tread with adhesive, machining the tread after the steps of mating the tongue and groove and securing the tongue and groove with adhesive, and adhesively securing said stair tread to stairs by adhesive applied along a width of said stair tread adjacent said stairs to prevent said stair tread from floating relative to said stairs.

2. The method of claim 1, further comprising the step of providing side nosing having a profile matching the profile of the front nosing and having a length greater than the width of the stair tread.

3. The method of claim 1, further comprising the step of cutting the side nosing to a length to fit the length of the stair tread when applied to an existing staircase.

4. The method of claim 2, further comprising the step of securing the side nosing to an edge of the stair tread adjacent to the front nosing.

5. A combination stair tread overlay for a staircase and stairs, comprising:

a generally planar stair tread having an outer surface and an inner surface and one of a tongue or groove along an edge thereof, said edge defining a vertical plane;

an elongated front nosing having a top surface, a bottom terminal surface, a front contoured nose surface and a planar back side surface, the other of a tongue or groove disposed on said planar back side surface thereof, a portion of said back side surface abutting said edge of said stair tread along said vertical plane;

said tongue and groove of said tread and front nosing secured together to form a joint to thereby connect said front nosing to said tread;

said top surface of said tread being flush with a top surface of said front nosing; and said front nosing extending in a direction away from said inner surface of said tread, wherein said stair tread is adhesively secured to stairs by adhesive applied along a width of said tread portion adjacent said stairs to prevent said tread portion from floating relative to said stairs.

6. The overlay of claim 5, further including an adhesive securing said front nosing and said tread.

7. The overlay of claim 5, further including a side nosing attached to a second edge of said tread.

8. The overlay of claim 7, wherein said side nosing has a profile that matches the profile of said front nosing.

9. A staircase installed in a building to provide personnel access between connected floors of the building, comprising:

a set of stairs including treads and risers supported by a stringer;

an overlay covering said stairs;

said overlay including a stair tread portion and a front nosing attached to said tread portion along one end of said tread portion;

said tread portion and said front nosing secured by a tongue and groove joint extending along the lengths of said tread portion and said front nosing, wherein said tread portion is adhesively secured to said stairs by adhesive applied along a width of said tread portion adjacent said stairs to prevent said tread portion from floating relative to said stairs.

10. The staircase of claim 9, further comprising a side nosing attached to said tread portion of said overlay at an edge adjacent to said front nosing.

11. The staircase of claim 9, wherein a top surface of said tread portion is flush with a top surface of said front nosing.

12. The staircase of claim 9, wherein said joint includes adhesive between said tread portion and said front nosing.

13. The staircase of claim 10, wherein the profile of said side nosing matches the profile of said front nosing.

* * * * *